US005172087A

United States Patent [19]

Castonguay et al.

[11] Patent Number: 5,172,087

[45] Date of Patent: Dec. 15, 1992

[54] HANDLE CONNECTOR FOR MULTI-POLE CIRCUIT BREAKER

[75] Inventors: Roger N. Castonguay, Terryville; David Arnold, Chester, both of Conn.

[73] Assignee: General Electric Company, New York, N.Y.

[21] Appl. No.: 828,627

[22] Filed: Jan. 31, 1992

[51] Int. Cl.[5] ..... H01H 9/20

[52] U.S. Cl. ..... 335/160; 200/50 C

[58] Field of Search ..... 200/50 R, 50 C; 335/159-162

[56] References Cited

U.S. PATENT DOCUMENTS 3,703,614 11/1972 Zubaty et al. ..... 200/50 C
4,679,016 7/1987 Ciarcia et al. ..... 335/132
4,980,525 12/1990 Kakisako ..... 200/50 R

*Primary Examiner*—Lincoln Donovan
*Attorney, Agent, or Firm*—Richard A. Menelly

[57] ABSTRACT

A multi-pole circuit breaker is formed from a modular array of single-pole circuit breakers. The individual circuit breaker operating handles are ganged together by means of a handle connector placed over the individual circuit breaker operating handles. The handle connector has a U-shaped central part flanked by a pair of C-shaped parts disposed on the outside portions thereof to facilitate switching the individual operating handles in unison.

12 Claims, 2 Drawing Sheets

HANDLE CONNECTOR FOR MULTI-POLE CIRCUIT BREAKER

BACKGROUND OF THE INVENTION

Economic considerations in product design have made multi-pole circuit breakers an attractive alternative to single-pole circuit breakers. A multi-pole circuit breaker for purposes of this disclosure is defined as a modular array of single-pole circuit breakers connected together by means of fastening. Each single-pole circuit breaker, as described in U.S. Pat. No. 4,679,016, includes its own positional (ON and OFF) operating handle protruding from the circuit breaker case. The handle controls the operating mechanism disposed within the circuit breaker enclosure. The ON position indicates that the circuit is closed, or in operation, while the OFF position indicates that the circuit is open, or disengaged.

Multi-pole circuit breakers require that all operating handles be set to their ON and OFF positions in unison. Simultaneous switching of the handles can be accomplished by various connecting bar designs. Currently, a number of methods exist for connecting circuit breaker handles. A conventional handle connector is simply a C-channel shaped metal bar enclosing all operating handles and attached thereto. Another design is a handle connector molded with the operating handles as a single piece. Yet another method uses an elongated rivet inserted through the operating handles which employs a handle tie bar as a common operating handle enclosure as described, for example, in U.S. Pat. No. 4,980,525.

However, no known handle connector used with multi-pole circuit breakers completely eliminates the problem of time lag in opening or closing the associated electric circuit when an operator applies force to the end portion of the handle connector, rather than the middle portion thereof. In a four-pole circuit breaker-handle connector according to the prior art, a force applied to one end of the handle connector, the circuit breaker operating handle at the opposite end of the handle connector is subjected to a time delay because some of the applied force is dissipated through the handle connector instead of being applied to the operating handle at the opposite end. As the number of single-pole circuit breakers ganged together increases, the time lag becomes more problematic.

SUMMARY OF THE INVENTION

The invention comprises a handle connector arranged over the operating handles of a multi-pole circuit breaker array thereby facilitating the turning of the operating handles of the individual circuit breakers from their ON-to-OFF and OFF-to-ON conditions, in unison. The handle connector, having a U-shaped middle channel and two outer C-shaped channels with flared wings, thereby directs an operator-applied force to the middle portion of the connector to uniformly turn the multi-circuit breaker array from ON-to-OFF and OFF-to-ON conditions. The time lag in the individual circuit breaker response when turning the multiple circuit breakers to either the ON or OFF condition is substantially eliminated.

DESCRIPTION OF THE PREFERRED EMBODIMENT

Figure 1:
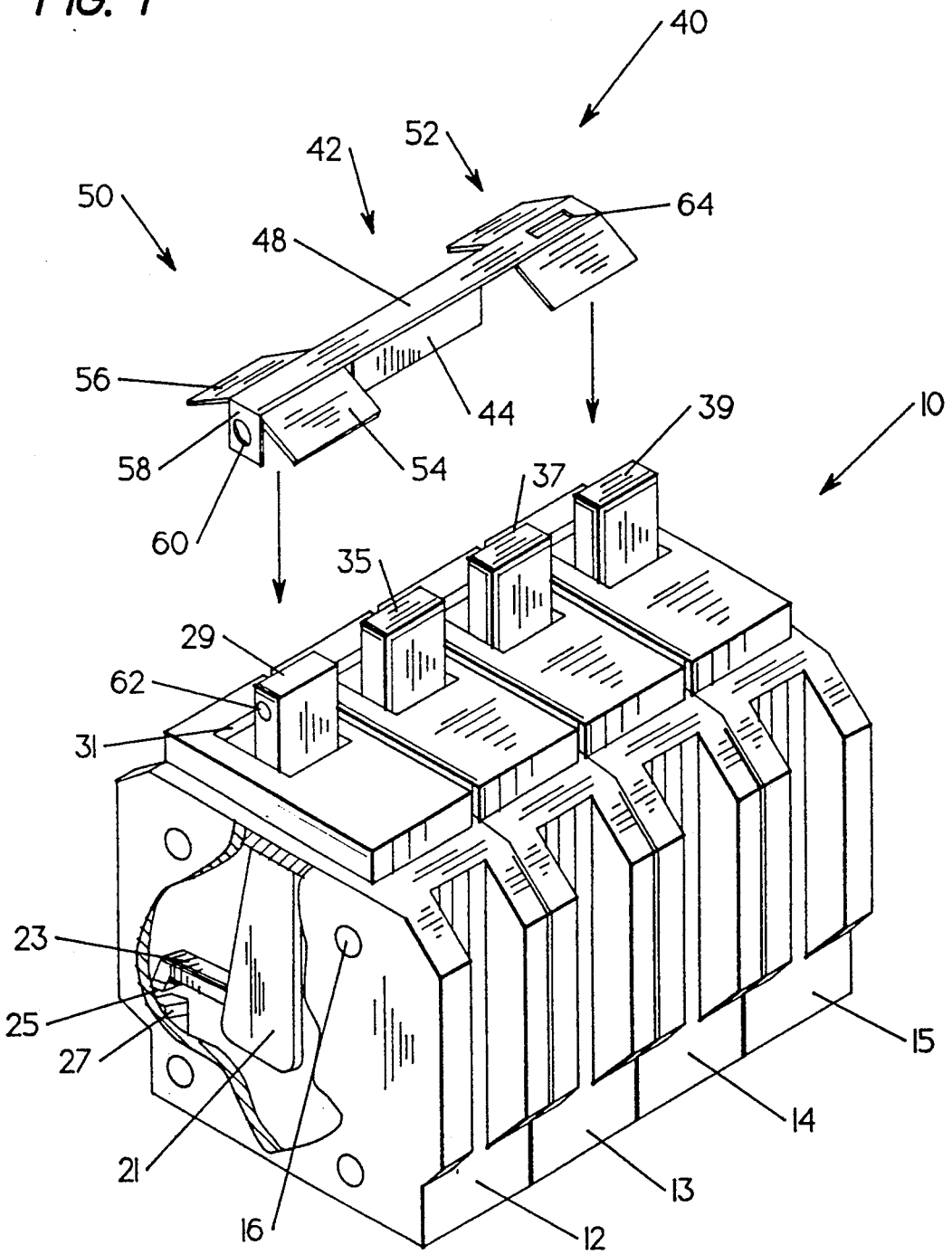
FIG. 1 is a top perspective view, in partial section of a four-pole circuit breaker with the handle connector in isometric projection in accordance with the present invention.

Referring to FIG. 1, a four-pole circuit breaker 10 includes four single-pole circuit breakers 12–15 ganged together by means of four fasteners as indicated at 16. Each single-pole circuit breaker 12–15 is similar to that described in U.S. Pat. No. 4,679,016.

Each individual circuit breaker includes an operating mechanism 21 that drives the movable arm 23 with the attached movable contact 25 out of circuit with the fixed contact 27 upon occurrence of overload circuit conditions. The open and closed positions of the movable contact arm 23 is manually controlled by an operating handle 29 protruding through an opening 31 in the circuit breaker case under quiescent circuit conditions.

The four-pole circuit breaker 10 has four operating handles 29, 35, 37, 39 one for each single-pole circuit breaker 12–15. Each operating handle has ON and OFF positions corresponding to the ON and OFF positions of the associated movable contact arm 23. In accordance with the teachings of the invention, a handle connector 40 is fitted over the four operating handles 29, 35, 37, 39 in a slidingly engaging manner to facilitate the operation of the four handles, which then can be moved from ON-to-OFF and OFF-to-ON positions only in unison.

Figure 2:
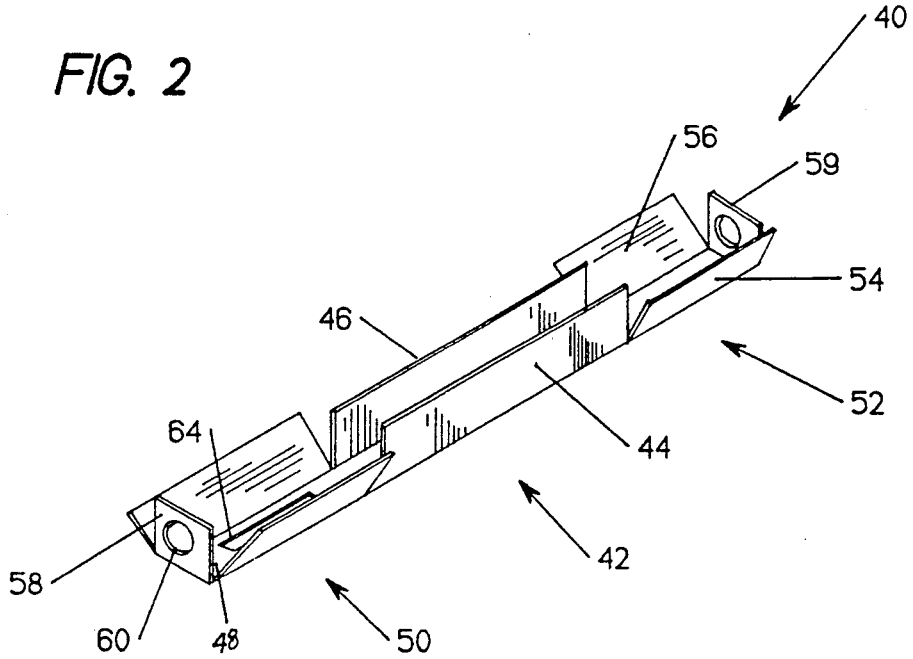
FIG. 2 is an enlarged top perspective view of the underside of the handle connector of FIG. 1.

As best seen by referring now to both FIGS. 1 and 2, the handle connector 40 comprises a single metal piece which includes a U-shaped middle channel 42 defined by a pair of opposing side walls 44, 46, a pair of outer C-shaped channels 50, 52 and a connecting bottom part 48. The side walls 44, 46 extend in an upright position from the bottom part 48, as viewed in FIG. 2, which is in the form of a substantially flat surface extending longitudinally from one end of the handle connector 40 to the other end thereof. The C-shaped outer parts 50, 52 have structures similar to each other, consisting of a leading arm 54 and a trailing arm 56, which extend from opposite sides of the bottom part 48. The leading arm 54 has a substantially flat surface forming an obtuse inside angle with the substantially flat surface of the bottom part 48 to deter an operator from applying force thereto when turning the circuit breaker handle to the ON position. The angled surface accordingly requires a substantially greater amount of force compared to that applied to the middle part to effect turning the circuit breaker handle to the ON position.

The trailing arm 56 is also bent at an angle from the flat surface of the bottom part 48. In the embodiment depicted, the trailing arm 56 is shorter relative to the leading arm 54 due to geometrical limitations imposed by the circuit breaker assembly. The trailing arm 56 also functions to require a substantially greater amount of force than to the middle part 42 of the handle connector 40 when switching the circuit breaker handle to the OFF position. In the best mode embodiment, the leading arm 54 forms an obtuse angle of approximately 160° with the flat surface of the bottom part 48, whereas the trailing arm 56 forms an angle of approximately 150° angle with the same bottom surface. The opposing side walls 44, 46 of the middle part are arranged perpendicular to the planar surface of the bottom part 48. The angles defined between the leading and trailing arms 54, 56 and the bottom surface are not limited to specific dimensions and may be varied in accordance with a particular design providing the angles defined between the arms and the bottom surface exceed the angles defined between the side walls 44, 46 and the same bottom surface. The arms 54, 56 have rounded outer corners and inward bent inner edges to avoid personal injury to the operator.

As best seen in FIG. 2, the opposite ends of the handle connector 40 have tabs 58, 59 bent perpendicularly to the flat surface of the bottom part 48 to secure the connector to the operating handles. The tabs have a substantially round slot 60 formed therein corresponding to similarly round slots 62 (FIG. 1) formed in the two outermost operating handles 29, 39 positioned adjacent to the tabs 58. Fasteners (not shown) are inserted through the slots 60, 62 to secure the handle connector to the operating handles. A small window 64 formed in the bottom part 48 allows the operator to read the circuit breaker label located on the end of the circuit breaker handle.

Figure 3:
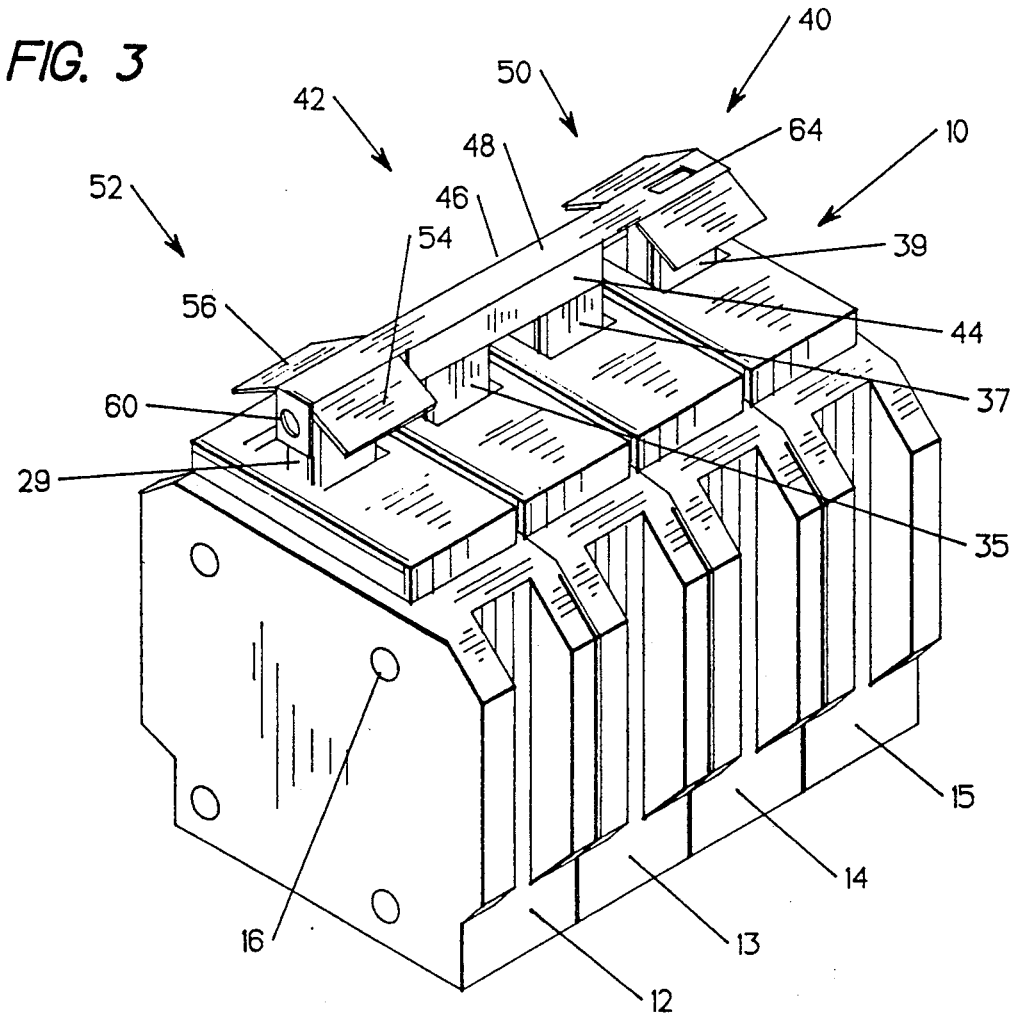
FIG. 3 is a top perspective view of an assembly of the four-pole circuit breaker and the handle connector of FIG. 1.

With the handle connector 40 attached to the multi-pole circuit breaker 10 depicted in FIG. 3, the middle part 42 encloses the two operating handles 35, 37 on the innermost circuit breakers 13, 14 while the two outer parts 50, 52 are disposed over the two operating handles 29, 39 on the two outermost circuit breakers 12, 15. Thus, when an operator applies force to the middle part, the side walls 44, 46 of the middle part initiate movement of the two inner operating handles 29, 39, while the two outer operating handles 35, 37 move in unison with the two inside operating handles since they are fastened to the ends of the handle connector 40. Thus, when an operator applies force to the middle part 42 of the handle connector, all four operating handles 29, 35, 37, 39 move in unison.

Conversely, when an operator applies manual force to either of the two outer parts 50, 52 by means of the arms 54, 56 insufficient force is transmitted to any of the operating handles to cause any movement thereof.

Although the handle connector is stamped from a single sheet of steel, other metals can also be used. The handle connector could be molded from a thermoset plastic material providing that the necessary strength is maintained. The handle connector also may be used in conjunction with a conventional handle connector, if so desired.

Having thus described our invention, what we claim as new and desire to secure by Letters Patent is:

1. A multi-pole circuit breaker assembly comprising in combination:

a plurality of circuit breakers having a corresponding plurality of operating handles upstanding therefrom; and a handle connector comprising a unitary structure formed into a U-shaped central part and a pair of end parts on opposite sides of said central part, said central part being arranged over said operating handles on central ones of said circuit breakers, said end parts being arranged over said operating handles on end ones of said circuit breakers said end parts being shaped to deter motion of any of said operating handles when a material force is applied solely to said end parts.

2. The circuit breaker assembly of claim 1 wherein said end parts each comprise a pair of extending arms providing clearance between said associated operating handles on said end circuit breakers and a bottom surface of said end parts.

3. The circuit breaker assembly of claim 2 wherein said central part abuts said associated operating handles on said central circuit breakers whereby said central circuit breakers and said end circuit breakers are turned to their ON and OFF conditions when said central part is moved in first and second directions.

4. The circuit breaker assembly of claim 1 wherein said unitary structure includes a planar surface extending along said central part and said end parts.

5. The circuit breaker assembly of claim 4 including end tabs formed at opposing ends of said planar surface, said opposing end tabs being turned-down against side edges of said associated operating handles on said end circuit breakers whereby first apertures through said end tabs align with second apertures within said associated circuit breaker handles to thereby receive attachment means at opposite ends of said connector through said first and second apertures.

6. The circuit breaker assembly of claim 1 further including an aperture through a top part of said central channel in alignment with a top edge of one of said operating handles providing visual access to indicia formed on said one end.

7. The circuit breaker assembly of claim 1 wherein said end parts are formed to a C-shaped configuration.

8. A multi-pole circuit breaker operating handle connector comprising:

a unitary piece formed into a central U-shaped part;

a pair of wing-shaped end parts on opposite sides of said central part; and a pair of opposing end tabs on opposing ends of said end parts, said end tabs including means for attachment to a multi-pole circuit breaker operating handle.

9. The multi-pole circuit breaker operating handle connector of claim 8 including a planar surface extending along said central part and said end parts.

10. The multi-pole circuit breaker operating handle connector of claim 8 wherein said attaching means comprises an aperture formed through end tabs.

11. The multi-pole circuit breaker operating handle of claim 8 wherein said end parts include a pair of arms extending at an obtuse angle to said planar surface.

12. The multi-pole circuit breaker operating handle of claim 9 including an aperture formed therein providing visual access to indicia provided an end of an operating handle extending from said multi-pole circuit breaker.

* * * * *